US008991058B2

(12) United States Patent
Dimitris et al.

(10) Patent No.: US 8,991,058 B2
(45) Date of Patent: Mar. 31, 2015

(54) SHAVING BLADE UNIT AND SHAVER HAVING SUCH A BLADE UNIT

(71) Applicants: Efthimiadis Dimitris, Athens (GR); Gratsias Spiros, Kypseli-Athens (GR); Bozikis Ioannis, Koukaki-Athens (GR)

(72) Inventors: Efthimiadis Dimitris, Athens (GR); Gratsias Spiros, Kypseli-Athens (GR); Bozikis Ioannis, Koukaki-Athens (GR)

(73) Assignee: Bic Violex, Attiki (GR)

( * ) Notice: Subject to any disclaimer, the term of this patent is extended or adjusted under 35 U.S.C. 154(b) by 0 days.

(21) Appl. No.: 13/936,321

(22) Filed: Jul. 8, 2013

(65) Prior Publication Data

US 2014/0059861 A1 Mar. 6, 2014

Related U.S. Application Data

(62) Division of application No. 12/438,465, filed on Feb. 23, 2009, now Pat. No. 8,499,459.

(51) Int. Cl.

| | |
|---|---|
| ***B26B 21/40*** | (2006.01) |
| ***B26B 21/14*** | (2006.01) |
| ***B26B 21/52*** | (2006.01) |
| ***B26B 21/22*** | (2006.01) |

(52) U.S. Cl.

CPC ..... *B26B 21/40* (2013.01); *B26B 21/225* (2013.01); *B26B 21/4012* (2013.01); *B26B 21/4037* (2013.01); *B26B 21/4043* (2013.01)

USPC ..... 30/34.1; 30/50

(58) Field of Classification Search

CPC ..... B26B 21/255; B26B 21/4012

USPC ..... 30/34.1, 50, 77, 84, 527, 346.5, 526

See application file for complete search history.

(56) References Cited

U.S. PATENT DOCUMENTS

| | | | | |
|---|---|---|---|---|
| 1,923,439 | A | 8/1933 | Hukill | |
| 3,777,396 | A * | 12/1973 | Simonetti | 30/47 |
| 3,934,338 | A * | 1/1976 | Braginetz | 30/47 |
| 4,901,437 | A * | 2/1990 | Iten | 30/50 |
| 6,032,372 | A | 3/2000 | Dischler | |
| 6,161,288 | A * | 12/2000 | Andrews | 30/50 |
| 6,276,061 | B1 | 8/2001 | Rozenkranc | |
| 2001/0003869 | A1 | 6/2001 | Rocha | |
| 2005/0022386 | A1 * | 2/2005 | Macove | 30/50 |

FOREIGN PATENT DOCUMENTS

| | | |
|---|---|---|
| DE | 37 33 486 A1 | 4/1989 |
| EP | 0 638 014 81 | 6/1997 |

OTHER PUBLICATIONS

International Search Report for International Application No. PCT/IB2006/002318, mailed Apr. 23, 2007.

Written Opinion of the International Searching Authority for International Application No. PCT/IB2006/002318.

International Preliminary Report on Patentability for International Application No. PCT/IB2006/002318, completed Dec. 3, 2008.

* cited by examiner

*Primary Examiner* — Ghassem Alie

(74) *Attorney, Agent, or Firm* — Jones Day

(57) ABSTRACT

A shaving blade unit having a housing that includes a primary cap, a primary guard, an upper face, and a rear face. The shaving blade unit also includes a first primary blade located between the primary cap and the primary guard and extending at said the upper face, a first spacer stacked with the first primary blade, and a trimming blade extending at the rear face of the housing where the trimming blade is unreleasably fixed to the first spacer.

4 Claims, 11 Drawing Sheets

SHAVING BLADE UNIT AND SHAVER HAVING SUCH A BLADE UNIT

CROSS-REFERENCE TO RELATED APPLICATIONS

This is a divisional application of U.S. application Ser. No. 12/438,465, filed on Feb. 23, 2009, which is a national stage application of International Application No. PCT/IB2006/002318, filed on Aug. 25, 2006, the entire contents of these applications are incorporated herein by reference.

BACKGROUND OF THE INVENTION

1. Field of the Invention

Embodiments of the present invention is are concerned with safety shaving blade units and with shavers having such blade units.

More particularly, embodiments of the present invention relate to a shaving blade unit comprising:

a housing having a primary cap and a primary guard, the housing having an upper face and a rear face, a first primary blade located between the primary cap and the primary guard and extending at the upper face, a first spacer stacked with the first primary blade, and a trimming blade extending at the rear face of the housing.

Such a shaving blade unit allows:

a traditional shaving of the user's skin due to the primary guard, blade and cap, and a better shaving of skin areas constricted by adjacent protruding facial features, e.g. skin areas situated under the nose, near the ears, and the same due to the trimming blade.

To shave traditionally, a user brings the upper face of the housing in front of his skin, whereas to use the trimming blade, the user brings the rear face of the housing in front of his skin. Thus, the user turns the shaver handle an angle of approximately 180° to change from traditional shaving to trimming and vice versa.

2. Description of Related Art

Shavers have already been designed with one ore more primary blade(s) and one trimming blade, such as described, for example, in U.S. Pat. No. 4,901,437. However, the manufacturing of the shaving blade unit described in this document is quite difficult. As a matter of fact, when mounting the blade unit, the trimming blade and the primary blades are separately mounted on locating pins protruding from a cap, and then the locating pins are inserted in holes provided on the guard.

SUMMARY OF THE INVENTION

One object of embodiments of the present invention is to provide a shaving blade unit that is easier to manufacture. To this end, according to embodiments of the invention, the trimming blade is fixed to the first spacer. Because the trimming blade is fixed to the first spacer, the adjunction of the trimming blade does not complicate the process of mounting the blades and spacer(s) to the housing as compared to a shaving blade unit that does not include a trimming blade.

In various embodiments of the present invention, one may have recourse to one or several of the following dispositions:

the trimming blade is fixed to the first spacer by gluing;

the trimming blade is fixed to the first spacer by welding;

the trimming blade has a discontinuous cutting edge;

the shaving blade unit further comprises at least one additional trimming blade fixed to the first spacer;

the trimming blade may have a cutting edge having a smaller length than the length of the cutting edge of the first primary blade;

the shaving blade unit further comprises a second primary blade, the first spacer being interposed between the first and second primary blades, the first primary blade being near the primary cap, whereas the second primary blade is near the primary guard;

the shaving blade unit further comprises at least one additional primary blade located between the first and second primary blades, and at least one additional spacer interposed between the second primary blade and the at least one additional primary blade, the first spacer being interposed between the first primary blade and the at least one additional primary blade;

the shaving blade unit further comprises at least one additional trimming blade fixed to the at least one additional spacer;

the primary cap extends in the rear face of the housing to also form a trimming cap for the trimming blade and where a trimming guard is provided for the trimming blade in the rear face of the housing, the trimming blade being located between the trimming cap and the trimming guard; and the trimming blade extends in a plane at an angle comprising between 125° and 140° (e.g. approximately 130°) relative to a plane in which the first primary blade extends.

Embodiments of the present invention also concern a shaver comprising a handle and a shaving blade unit as described above, where the shaving blade unit is connected to the handle.

The above and other objects and advantages of embodiments of the present invention will become apparent from the detailed description of several embodiments of the invention, considered in conjunction with the accompanying drawings.

DESCRIPTION

In the various figures, the same references denote identical or similar elements.

Figure 1:
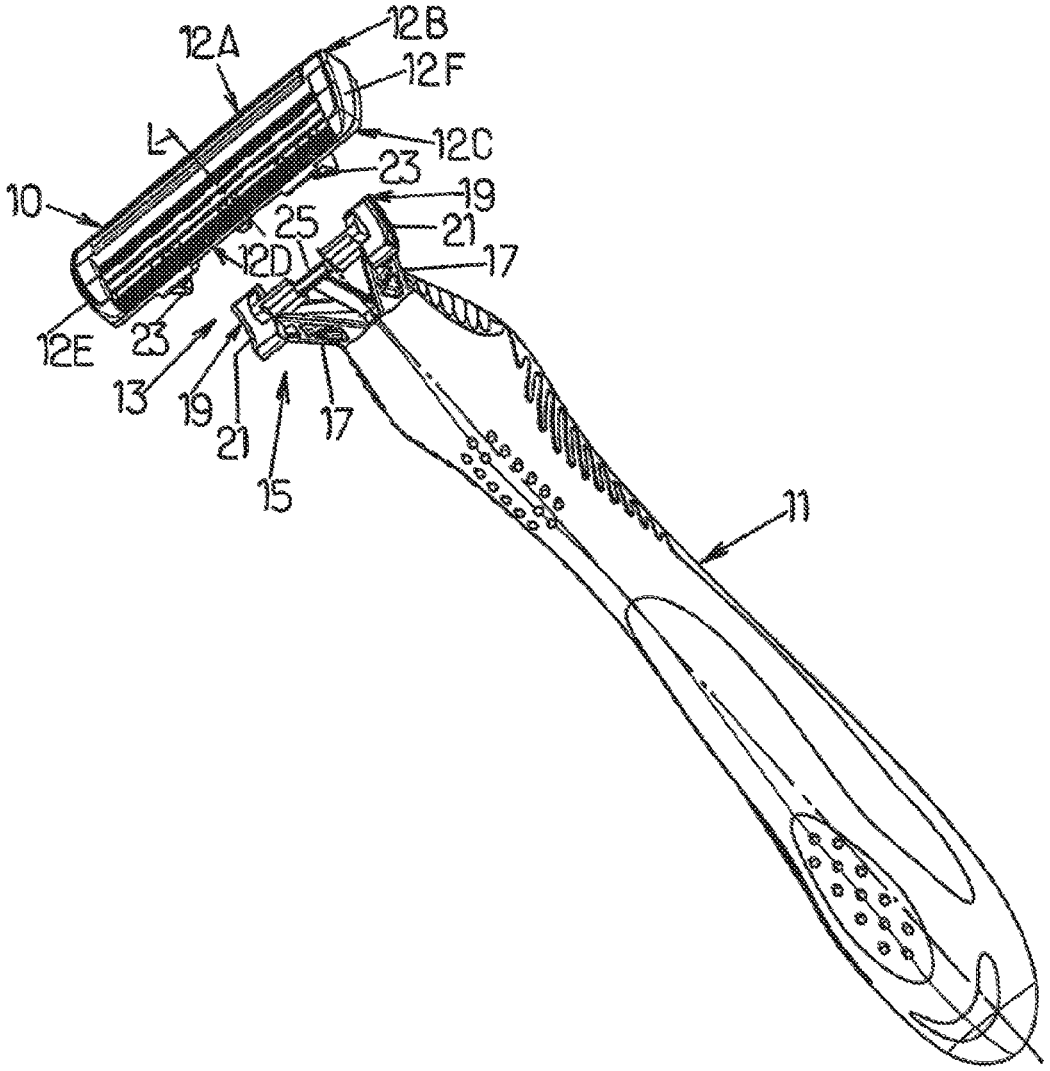
FIG. 1 is a perspective view of a shaver according to an embodiment of the present invention.

FIG. 1 illustrates a shaver comprising a shaving blade unit 10 (or shaving head) to be releasably connected to a shaver handle 11 through a head to handle attachment 13.

Figure 5:
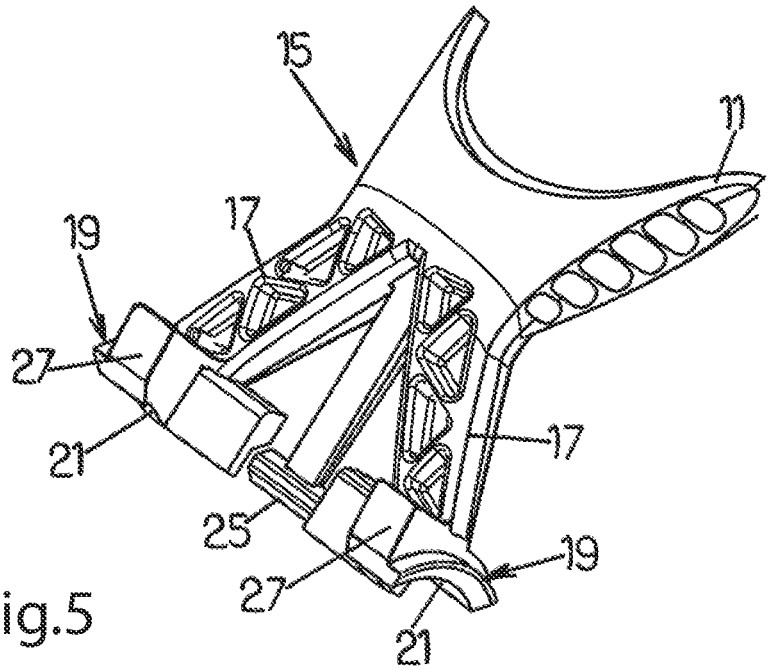
FIG. 5 is perspective view of the distal end of the handle belonging to the shaver of FIG. 1.

As shown in FIGS. 1 and 5, the handle 11 has a head portion 15 having a V-shaped pair of spaced arms 17 each provided at an end thereof, with bearing structures 19 for connection to the shaving blade unit 10.

Figure 2:
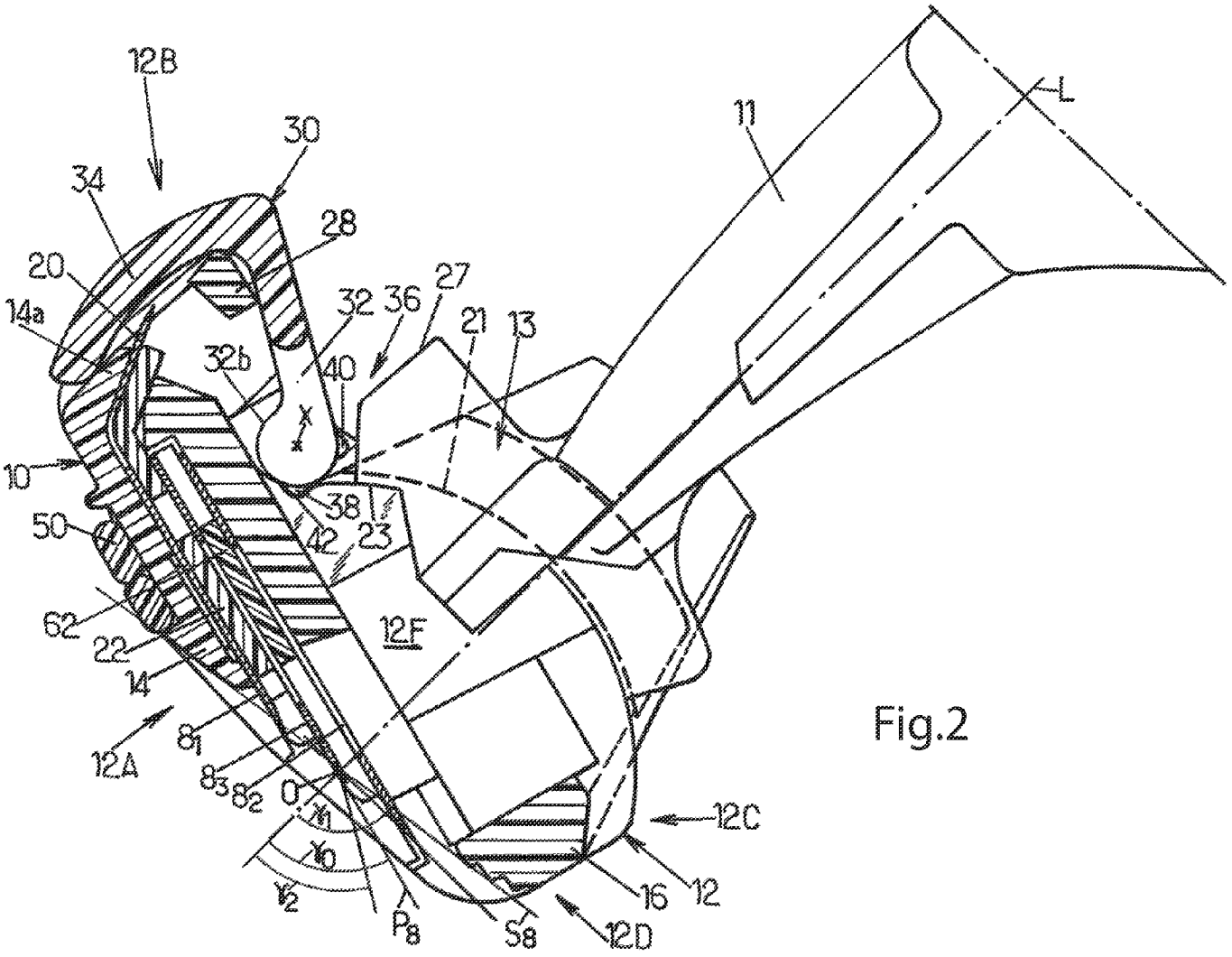
FIG. 2 is a cross-sectional view of the shaving blade unit and distal end of the handle of the shaver shown in FIG. 1, the shaving blade unit being in a rest position, in a configuration for normal shaving.

To allow pivoting of the shaving blade unit 10, the bearing structures 19 comprise actuate rails 21 to be clipped onto corresponding hooks 23 provided on the shaving blade unit 10, whereas a longitudinal flexible tongue 25 extending between the spaced arms 17 and able to cooperate with a groove formed on the shaving blade unit 10, provides a spring force that biases the shaving blade unit 10 towards a median rest position as illustrated in FIG. 2.

As depicted in FIG. 2, the shaving blade unit 10 comprises three primary blades: a first blade $\mathbf{8}_1$, a second blade $\mathbf{8}_2$ and an additional blade $\mathbf{8}_3$ located between the first blade $\mathbf{8}_1$ and the second blade $\mathbf{8}_2$. The pivoting center "O" of the shaving blade unit 10 is located on blade $\mathbf{8}_3$ between blades $\mathbf{8}_1$ and $\mathbf{8}_2$, in the vicinity of a reference plane $S_8$, which is tangent to the primary guard 16 and to the primary cap 14.

The shaving blade unit 10 is able to pivot freely between:

- a forward end position (illustrated in FIG. 3), in which the plane $P_8$ of the primary blades $\mathbf{8}_1$, $\mathbf{8}_2$ and $\mathbf{8}_3$ is separated from the longitudinal axis L by an angle $\gamma_1$, and
- a rear end position (not illustrated), in which the plane $P_8$ is separated from the longitudinal axis L by an angle $\gamma_2$ smaller than $\gamma_1$.

In the rest position, as illustrated in FIG. 2, the shaving blade unit 10 is located in a median position relative to the longitudinal axis L of the shaver, corresponding to a position in which the plane $P_8$ is positioned relative to the longitudinal axis L by an angle $\gamma_0$. The angle $\gamma_0$ corresponds to the average of the extreme angles $\gamma_1$ and $\gamma_2$:

$$\gamma_o = \frac{\gamma_1 + \gamma_2}{2}$$

The shaving blade unit 10 comprises a housing 12 having a primary cap 14 (usually provided with a lubricating strip 50) and a primary guard 16 (see FIG. 2). The housing 12 has an upper face 12A—that includes the primary cap 14 and primary guard 16, a rear face 12B, a lower face 12C, a front face 12D and two lateral faces 12E and 12F (see FIG. 1).

As shown on FIG. 2, the primary blades $\mathbf{8}_1$, $\mathbf{8}_2$ and $\mathbf{8}_3$ extend at—the upper face 12A of the housing 12 and are located between the primary cap 14 and the primary guard 16. The primary blades $\mathbf{8}_1$, $\mathbf{8}_2$ and $\mathbf{8}_3$ are stacked with a first spacer 22 and an additional spacer 62, which are interposed between the primary blades. Retaining pins (not illustrated), protruding from the cap, may go through the primary blades and the spacers and may be crimped so as to retain the primary blades and the spacers in the housing 12.

Here, the primary blade, which first contacts the skin in the direction of shaving, is the primary blade $\mathbf{8}_2$, called here "second primary blade," whereas the last primary blade in the direction of shaving is the primary blade $\mathbf{8}_1$, called here "first primary blade," and the middle primary blade is the primary blade $\mathbf{8}_3$, called here "additional primary blade."

The primary cap 14 extends in the rear face 12B of the housing 12 to form a trimming cap 14*a* for a trimming blade 20 that extends at the rear face 12B of the housing 12. Additionally, a trimming guard 28 is provided for the trimming blade 20 in the rear face 12B of the housing 12.

Figure 3:
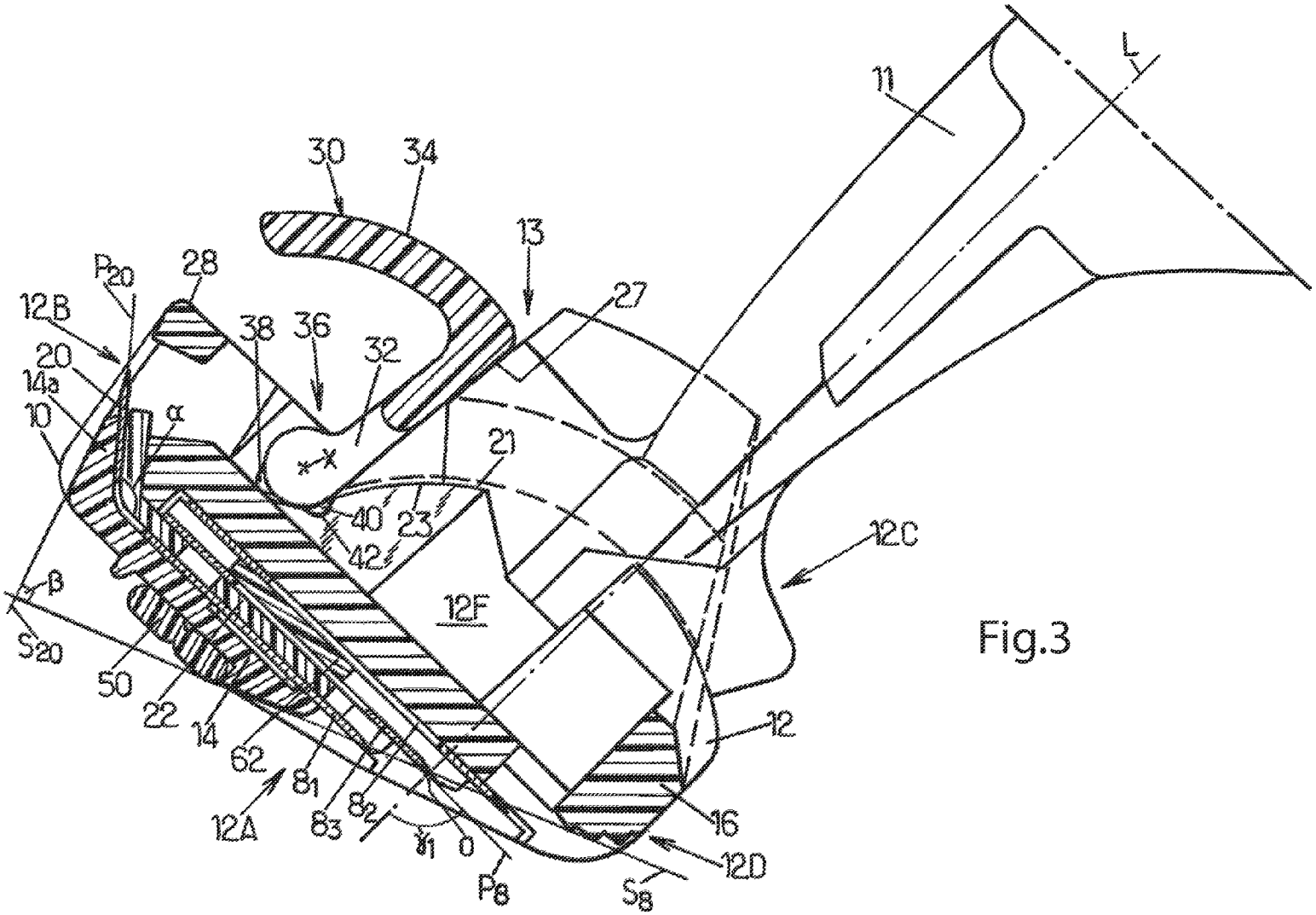
FIG. 3 is a figure similar to FIG. 2, showing the shaving blade unit in a trimming position.

Thus, the trimming blade 20 is located between the trimming cap 14 and the trimming guard 28 provided in the rear face 12B of the housing 12, as best illustrated in FIGS. 2 and 3.

The shaving blade unit 10 further comprises a trimming blade protector 30, which is able to selectively cover and uncover at least—the trimming blade 20.

The trimming blade protector can be either an independent element that can be separated from the shaving blade unit 10 or on the contrary, such trimming blade protector can be movably mounted on the housing 12 as depicted in FIG. 2.

In this latter case, the trimming blade protector 30 is preferably pivotally mounted on the housing 12, between a closed position, illustrated in FIG. 2, in which it covers the trimming blade 20, and an open position, illustrated in FIG. 3, in which the trimming blade 20 is exposed and usable.

Figure 4:
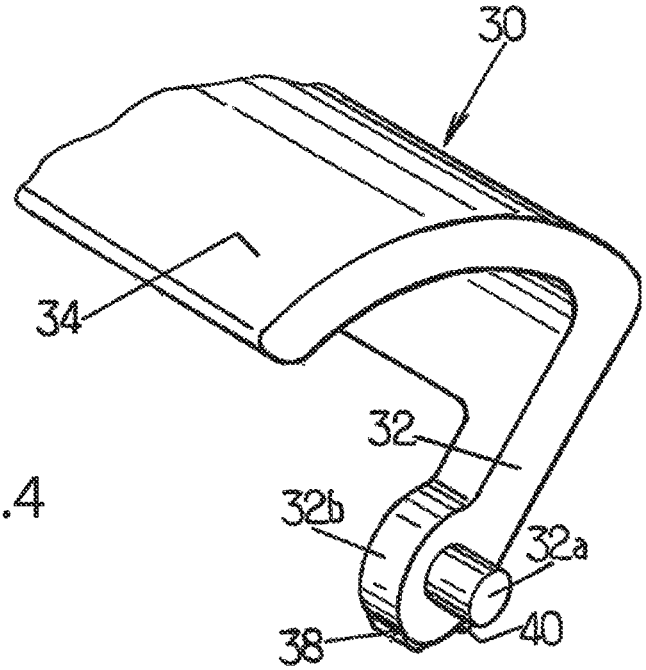
FIG. 4 is a perspective view of a trimming blade protector belonging to the shaving blade unit of the shaver according to FIG. 1.

As shown in FIGS. 2 to 4, the trimming blade protector 30, which may be made of a plastic material, may comprise two pivoting arms 32 pivotally connected to the rear face 12B of the housing 12 and a cover 34 extending between the two pivoting arms 32. The free end of each arm 32 may comprise a circular lug 32*a* extending along the pivoting axis X of the protector 30, the circular lug 32*a* being fitted into a corresponding hole (not shown) made in the lateral face 12F of the housing.

Further, the free end of each arm 32 may be rounded so as to form a cylindrical radial surface 32*b* that is centered on axis X. This radial surface 32*b* may contact a facing edge 23 belonging to the lateral face 12F of the housing, and may include radially protruding spigots 38, 40, which snap-fit into a corresponding groove 42 formed in the edge 23 when the trimming blade protector 30 in either in the open position or in the closed position. The spigots 38, 40 and groove 42 retain the trimming blade protector 30 in each of the closed and open positions.

The cover 34 is preferably shaped to cover the trimming guard 28, the trimming blade 20 and at least a part of the trimming cap 14 in the closed position. Consequently, in the closed position, the user—cannot cut himself inadvertently and no accidental movement can damage the trimming blade 20.

In case of a pivoting shaving blade unit as depicted on the figures, the pivoting of the shaving blade unit, which is very useful when shaving traditionally, is not required when trimming. On the contrary, it is then better to lock the shaving blade unit to shave more precisely.

In this case, as shown in FIG. 3, the trimming blade protector 30 can bear on a corresponding abutment face 27 of the handle 11 so as to maintain the shaving blade unit in the forward end position when the trimming blade protector is in the open position. Because the trimming action tends to pivot the shaving blade unit further forward, which is not possible as the shaving blade unit is already in the forwardmost position, the shaving blade unit remains locked in the forward end position during trimming. On the contrary, when the trimming blade protector is in the closed position, the shaving blade unit is free to pivot.

As best illustrated in FIG. 5, the abutment faces 27 may be protruding from the actuate rails 21 onto which the arms 32 of the trimming blade protector 30 come in abutment in the open position (see FIG. 3).

Figure 6:
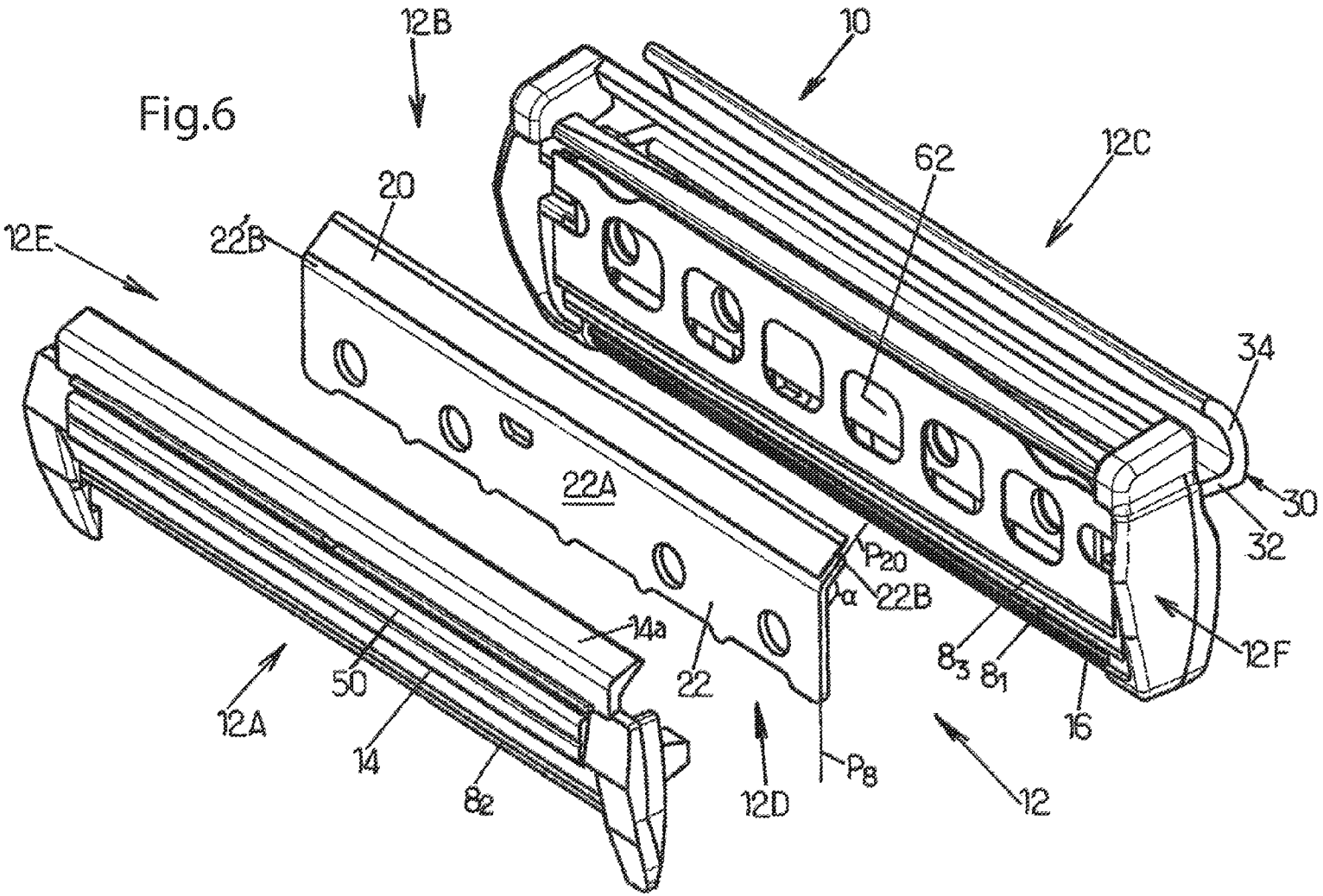
FIG. 6 is an exploded perspective view of the shaving blade unit of the shaver according to FIG. 1.

As best seen in FIG. 6, the trimming blade 20, which has a continuous cutting edge and which may be secured by gluing or spot welding to the first spacer 22, is stacked between the first primary blade $\mathbf{8}_2$ and the additional primary blade $\mathbf{8}_3$.

The first spacer 22 comprises two portions: a front portion 22A and a rear portion 22B provided with the trimming blade 20, where each of the front and rear portions has an upper side and a lower side. Here, for instance, the trimming blade 20 is secured to the upper side 22'B of the rear portion 22B. The trimming blade could also be fixed to the lower side of the first spacer 22, or to the upper or lower side of the additional spacer 62.

The rear portion 22B and the front portion 22A, which extends a plane parallel to the plane $P_8$ parallel to the primary blades $\mathbf{8}_1$, $\mathbf{8}_2$ and $\mathbf{8}_3$, are separated by an elbow 48 having an angle $\alpha$. To improve the ergonomics of the shaver, in particular when using the trimming blade, this elbow 48 has an angle $\alpha$ comprising between 125° and 140° relative to the head to handle attachment 13, so that the trimming blade 20 is located in a plane $P_{20}$ at the angle $\alpha$ to a plane Pg of the primary blades $\mathbf{8}_1$, $\mathbf{8}_2$ and $\mathbf{8}_3$.

This angle $\alpha$ is chosen in order to attain an angle $\beta$ approximately 90° between the reference surface $S_8$ of the primary blades and a reference surface $S_{20}$ of the trimmer blade (best illustrated in FIG. 3), where the reference surface $S_{20}$ allows a good positioning of the trimming blade 20 relative to the handle 11. Consequently, the user can use the shaver safety for traditional shaving or for trimming. To shave traditionally, the user just has to hold the handle 11 as usual, and to use the trimming blade 20, he has just to turn the handle 11 of about 180° around its longitudinal axis L.

Figure 7A:
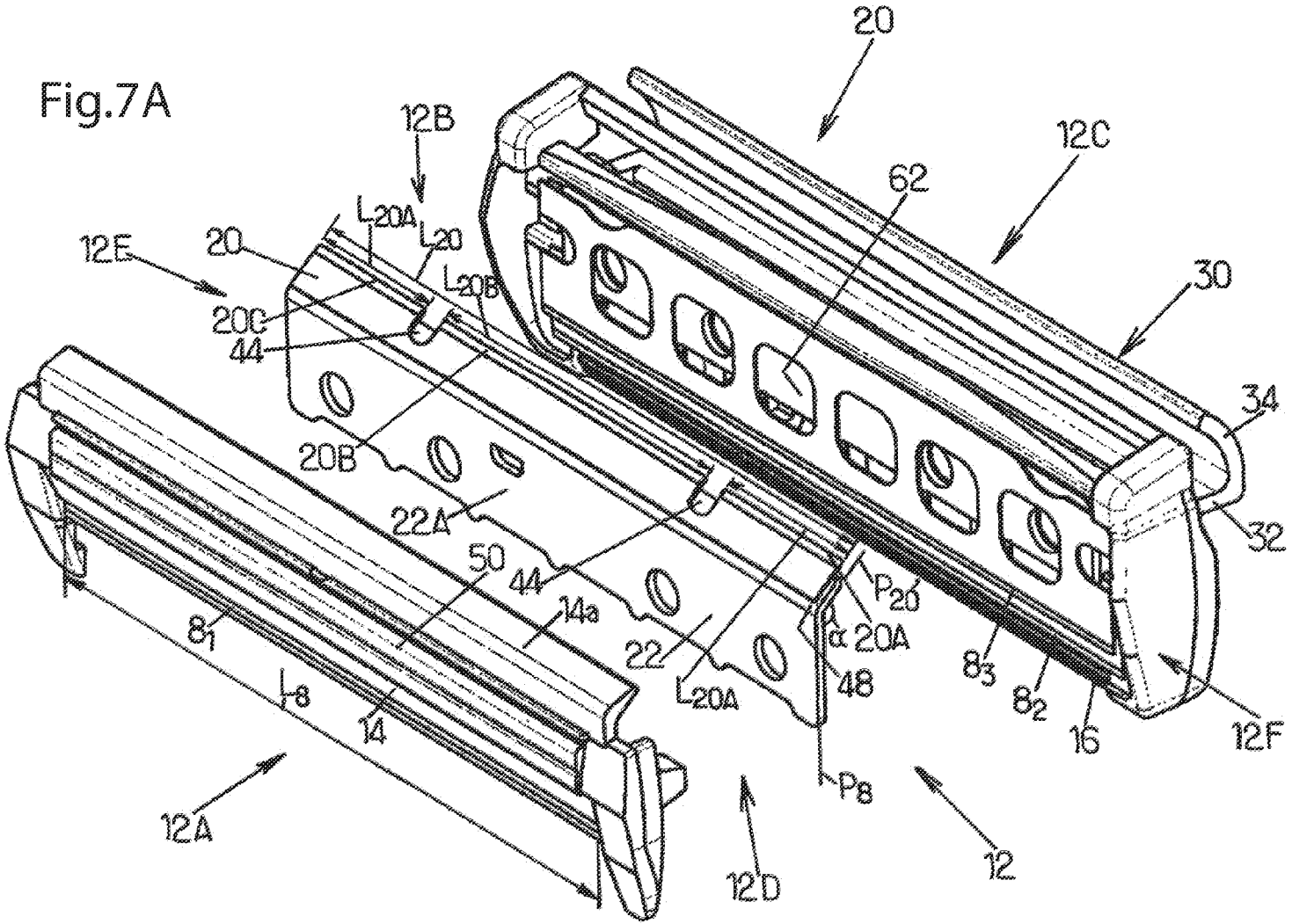
FIG. 7A is an exploded perspective views of shaving blade unit according to another embodiment of the present invention, in which the cutting edge of the trimming blade 20 is discontinuous.

The embodiment illustrated in FIG. 7A is similar to the embodiment already discussed hereabove and thus will not be described again here. This embodiment differs from that of FIGS. 1-6—in that the cutting edge of the trimming blade 20 is discontinuous, so as to obtain a particular pattern of the shaved hair. More particularly, in the embodiment of FIG. 7A, the cutting edge of the trimming blade has three separate cutting portions 20A, 20B and 20C, which are separated by two notches 44 that are cut out in the cutting edge of the trimming blade.

As illustrated in FIG. 7A, the trimming blade 20 may be of the same length $L_{20}$ as the length $L_8$ of the primary blades $\mathbf{8}_1$, $\mathbf{8}_2$ and $\mathbf{8}_3$, but it can be shorter or longer as in the other embodiments of the invention. Further, the three separate cutting portion edges 20A, 20B and 20C can be of the same or of different lengths, respectively, $L_{20A}$, $L_{20B}$ and $L_{20C}$.

Figure 7B:
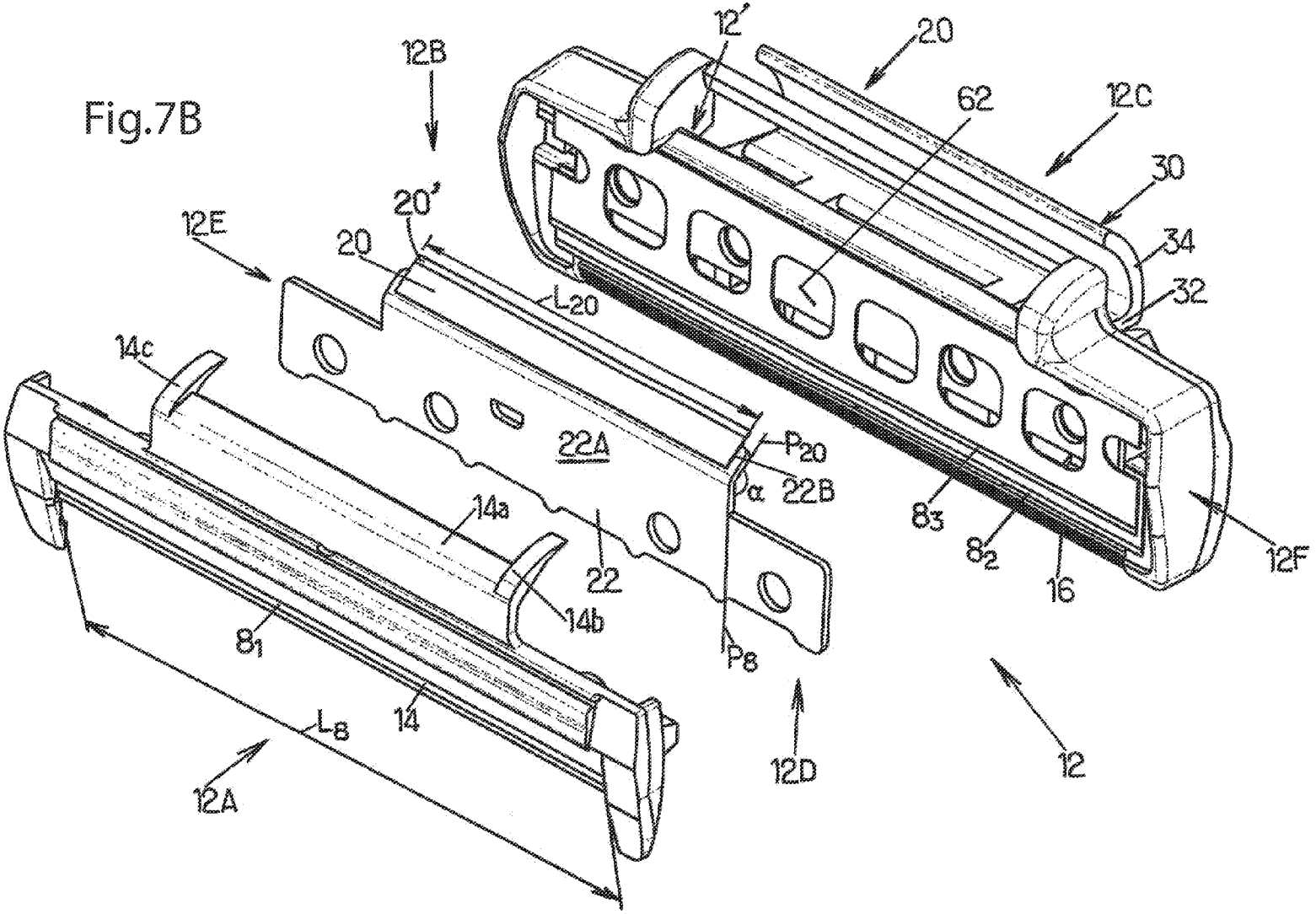
FIG. 7B is an exploded perspective view of a shaving blade unit according to another embodiment of the present invention, in which the trimming blade 20 is a precision trimmer blade, and includes a continuous edge 20'.
Figure 7C:
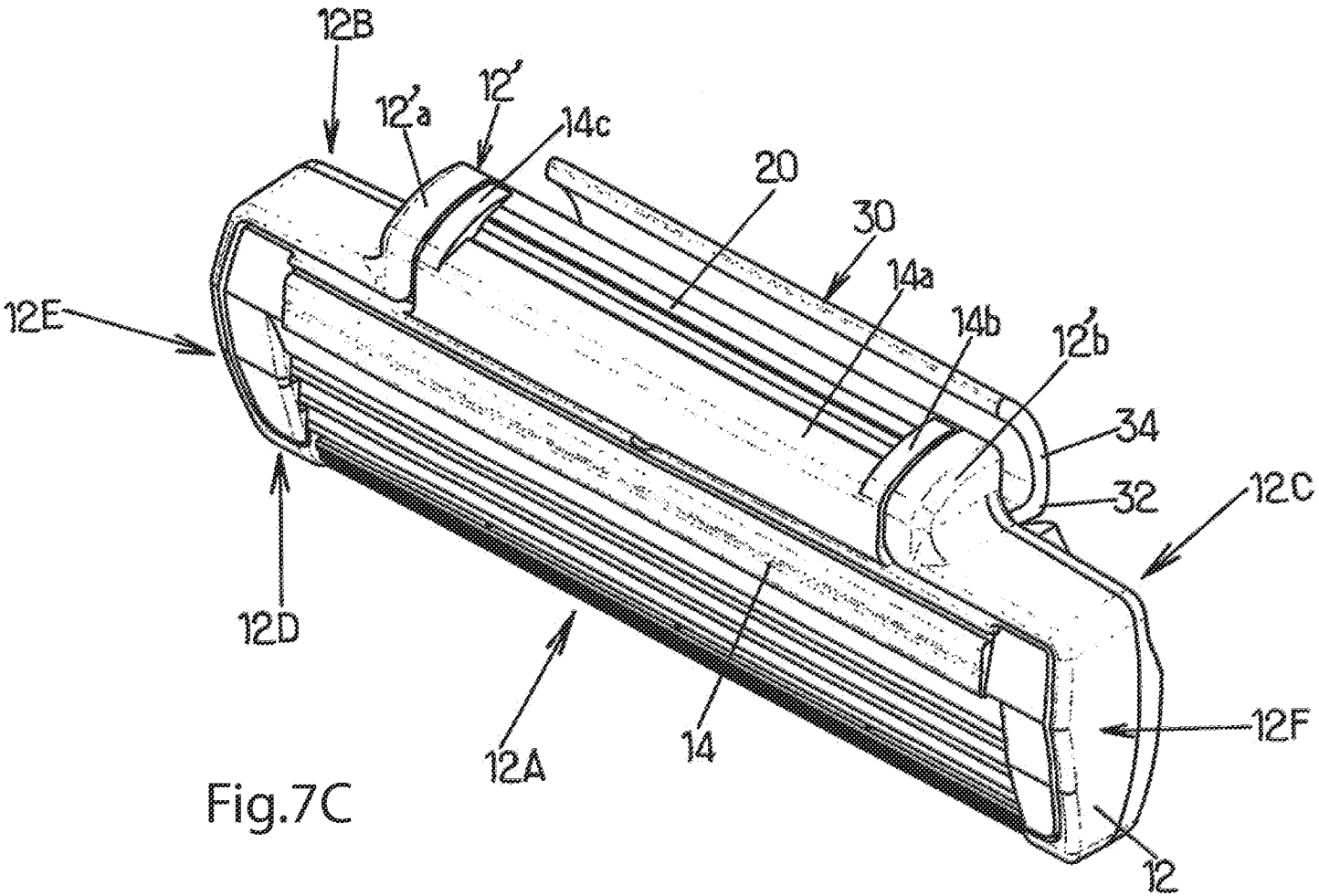
FIG. 7C is a perspective view of the assembled shaving blade unit shown in FIG. 7B, in which the trimming blade 20 is a precision trimmer blade, and includes a continuous edge 20'.

In the embodiment illustrated in FIGS. 7B and 7C, the trimmer blade 20 is a precision trimmer blade. In fact, this trimmer blade 20 has a continuous edge 20', but its length $L_{20}$ is smaller than the length $L_8$ of the primary blades $\mathbf{8}_1$, $\mathbf{8}_2$ and $\mathbf{8}_3$. For instance, the length $L_{20}$ is around ⅔ of the length $L_8$ of the primary blades $\mathbf{8}_1$, $\mathbf{8}_2$ and $\mathbf{8}_3$, such that the trimming can be more precise than with a longer trimmer blade and can, in particular, reach difficult areas.

The rear portion 22B of the spacer 22 onto which the trimmer blade 20 is fixed is shaped accordingly. In fact, the rear portion 22B of the spacer 22 is smaller (in length) than its front portion 22A.

The housing 12 is also shaped accordingly. In particular, it comprises a smaller protruding part 12' in which the trimmer blade 20 extends and the trimming cap 14*a* and the cover 34 of the trimming blade protector 30 have a suitable length so that in the closed position, the cover 34 covers the trimming blade 20.

As best seen in FIG. 7C, the protruding part 12' can be delimited by two lateral flanges 12'*a* and 12'*b* protruding from the rear face 12B and surrounding two lateral flanges 14*b* and 14*c* provided on the trimming cap 14*a*. These two lateral flanges 14*b* and 14*c* protrude toward the lower face 12C and laterally surround the trimmer blade 20.

Figure 8:
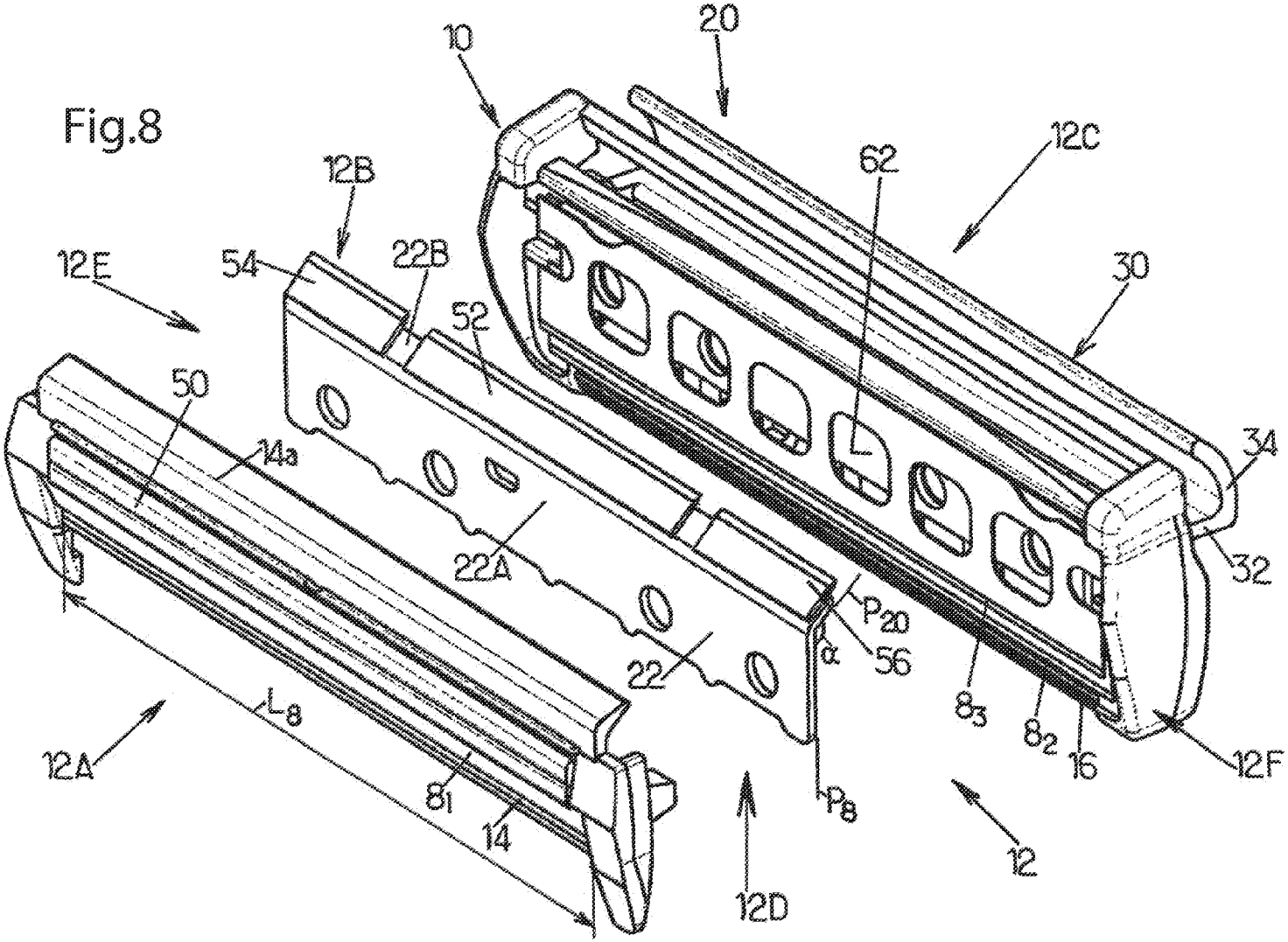
FIG. 8 is an exploded perspective view of a shaving blade unit according to another embodiment of the present invention, in which the trimming blade includes three trimming blades 52, 54, 56 that are fixed by gluing or welding in a juxtaposed manner on the first spacer 22, instead of one single trimming blade 20 shown in FIGS. 7A, 7B, and 7C.

In the embodiment of FIG. 8, three trimming blades 52, 54, 56 are fixed by gluing or welding in juxtaposed manner on the first spacer 22 instead of one single trimming blade 20 as described above. The lengths of the cutting edges of these trimming blades 52, 54, 56 may be similar or different from the lengths of the cutting portions of the trimming blade of FIG. 7.

Figure 9:
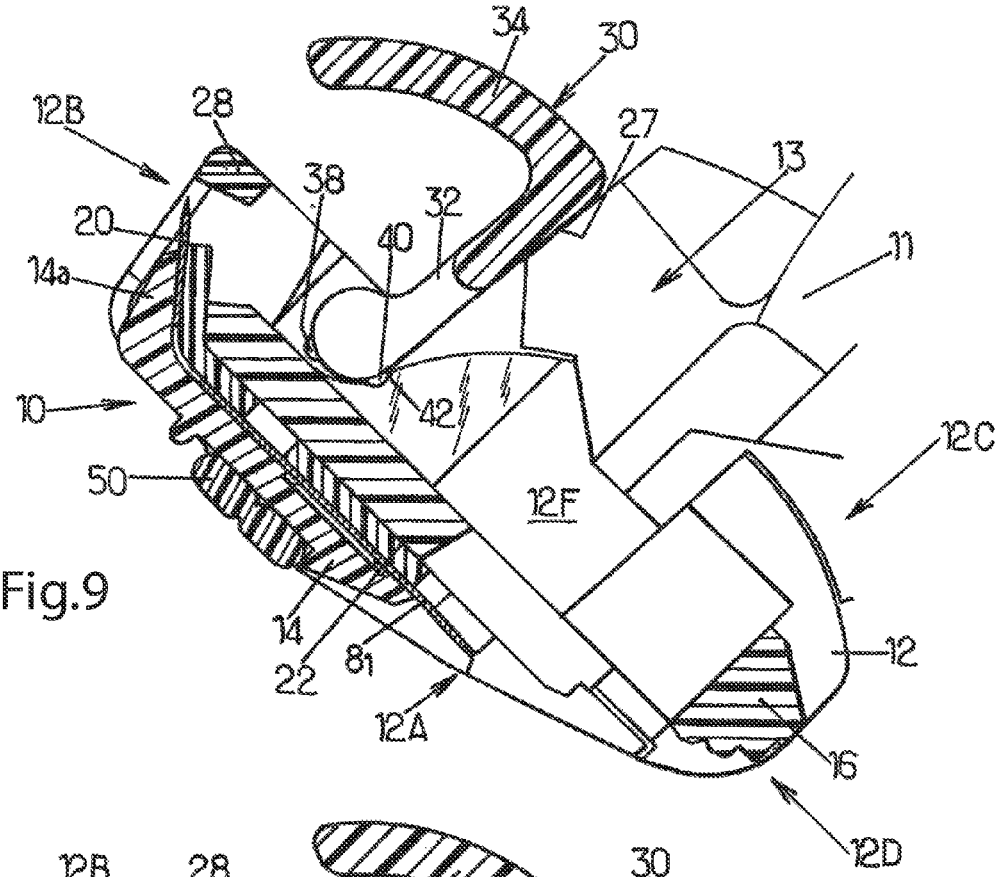
FIG. 9 shows the shaving blade unit in a trimming position, in which the shaving blade unit 10 only has one (81) primary blade and one single spacer 22 on which the trimming blade 20 is fixed.
Figure 10:
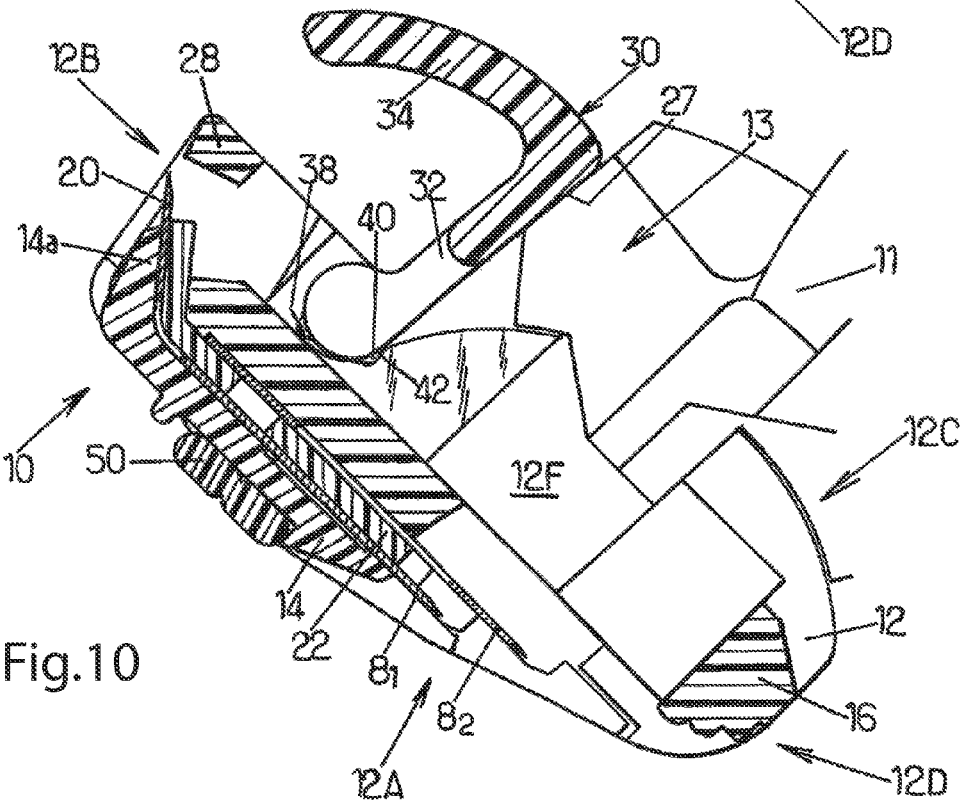
FIG. 10 shows the shaving blade unit in a trimming position, in which the shaving blade unit 10 has two (81) (82) primary blades and one single spacer 22 on which the trimming blade 20 is fixed.

The embodiments illustrated respectively in FIGS. 9 and 10, differ from the preceding embodiments in that the shaving blade unit 10 only has one ($\mathbf{8}_1$) or two ($\mathbf{8}_1$, $\mathbf{8}_2$) primary blades and one single spacer 22 on which the trimming blade 20 is fixed.

Figure 11:
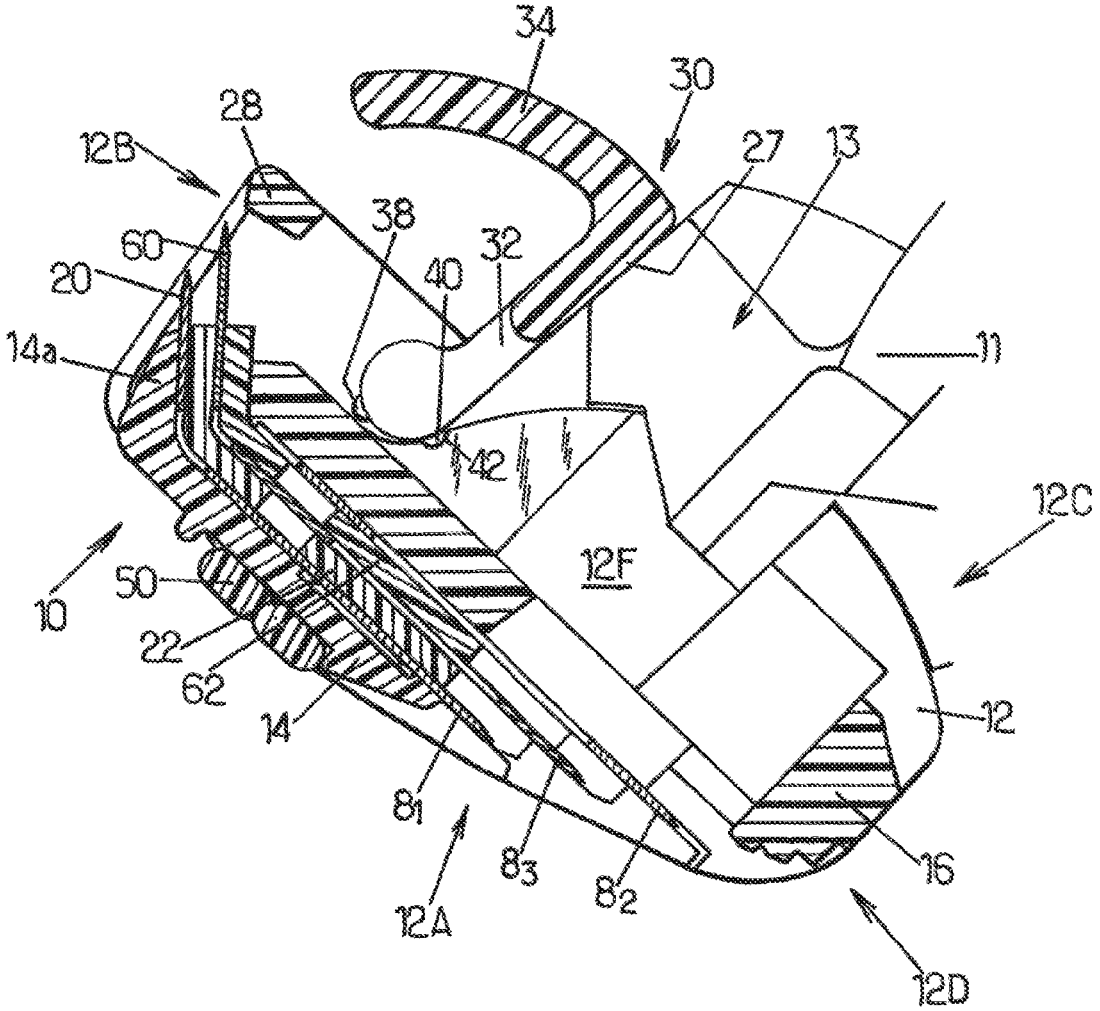
FIG. 11 shows the shaving blade unit in a trimming position, in which the shaving blade unit 10 has an additional trimming blade 60 fixed to the additional spacer 62, in a similar fashion as the trimming blade 20, where the trimming blades 20, 60 are parallel to one another.

In the embodiment of FIG. 11, an additional trimming blade 60 is fixed to the additional spacer 62, in a similar fashion as the trimming blade 20. The trimming blades 20, 60 are parallel to one another.

The invention claimed is:

1. A shaving blade unit comprising:

a housing having a primary cap and a primary guard, the housing having an upper face and a rear face;

a first primary blade located between the primary cap and the primary guard and extending at the upper face;

a first spacer stacked with the first primary blade; and a trimming blade extending at the rear face of the housing, wherein the trimming blade is unreleasably fixed to the first spacer, at least one additional trimming blade fixed to the first spacer, wherein the first spacer comprises a front portion and a rear portion, and the front and rear portions are separated by an elbow which has an angle between 125 degrees and 140 degrees, and wherein the primary blade is located in a plane, and the trimming blade is located in a plane at an angle comprised between 125 degrees and 140 degrees to the plane of the primary blade.

2. The shaving blade cartridge according to claim 1, wherein the first primary blade includes a length, and the trimming blade and/or the additional trimming blade comprise(s) a length which is around two-thirds of the length of the first primary blade.

3. The shaving blade unit according to claim 2, wherein the trimming blade and/or the additional trimming blade is fixed to the first spacer by means for attaching including gluing and spot welding.

4. The shaving blade unit according to claim 1, further comprising:

a reference surface tangent to the primary guard and to the primary cap, a trimming guard at the rear face of the housing, wherein the primary cap extends in the rear face of the housing forming a trimming cap for the trimming blade, wherein the trimming blade is located between the trimming cap and the trimming guard, and a reference surface tangent to the trimming guard and to the trimming cap, wherein the reference surface tangent to the trimming guard and to the trimming cap and the reference surface tangent to the primary guard and to the primary cap define an angle approximately 90 degrees.

* * * * *